US008448301B2

(12) United States Patent
Shaffer

(10) Patent No.: US 8,448,301 B2
(45) Date of Patent: May 28, 2013

(54) TOOL SET FOR MARINE APPLICATIONS

(76) Inventor: Brad E. Shaffer, Boca Raton, FL (US)

( * ) Notice: Subject to any disclaimer, the term of this patent is extended or adjusted under 35 U.S.C. 154(b) by 0 days.

(21) Appl. No.: 12/945,831

(22) Filed: Nov. 12, 2010

(65) Prior Publication Data

US 2013/0087592 A1 Apr. 11, 2013

Related U.S. Application Data

(60) Provisional application No. 61/260,832, filed on Nov. 12, 2009.

(51) Int. Cl.
*A45C 13/26* (2006.01)

(52) U.S. Cl.
USPC ..... 16/428; 16/422; 16/425; 16/444

(58) Field of Classification Search
USPC ..... 16/428, 422, 423, 425, 442, 444, 16/445; 294/16, 17, 26, 142, 149, 153, 158, 294/166, 170, 171; 403/220, 221, 224, 225, 403/269, 270, 297, 298, 191, 366, 367; 482/81, 482/82, 49, 126, 127; 24/265 H
See application file for complete search history.

(56) References Cited

U.S. PATENT DOCUMENTS

| | | | | | |
|---|---|---|---|---|---|
| 196,939 | A * | 11/1877 | Sabin | 24/265 H |
| 1,742,867 | A * | 1/1930 | Levi | 16/114.1 |
| 2,712,196 | A * | 7/1955 | Allen | 43/43.1 |
| 3,221,746 | A * | 12/1965 | Noble | 606/155 |
| 3,711,130 | A * | 1/1973 | Betzler | 285/239 |
| 3,722,130 | A * | 3/1973 | Handl | 43/44.98 |
| 3,788,156 | A * | 1/1974 | Jackson | 474/255 |
| 3,898,760 | A * | 8/1975 | Klein | 43/44.83 |
| 3,988,852 | A * | 11/1976 | Klein | 43/44.83 |
| 4,959,891 | A * | 10/1990 | Chou | 24/265 A |
| 6,880,289 | B1 * | 4/2005 | Yin | 43/44.98 |
| 8,141,208 | B2 * | 3/2012 | Fawcett, Jr. | 16/422 |
| 2004/0146341 | A1 * | 7/2004 | Sundheimer et al. | 403/270 |

FOREIGN PATENT DOCUMENTS

| | | | |
|---|---|---|---|
| FR | 2813770 | A1 * | 3/2002 |
| GB | 2332932 | A * | 7/1999 |

* cited by examiner

*Primary Examiner* — Chuck Y. Mah
(74) *Attorney, Agent, or Firm* — John C. Smith

(57) ABSTRACT

A toolset for marine applications that includes improved handle for buckets that provides an improved flexible gripping strap, and further provides a method of securely attaching the flexible gripping strap to specially formed spiked hooks that attach to a bucket. The spiked hook is inserted into a central channel of the flexible gripping strap. The hook has a distal end with angled spikes that allow the hook to be inserted into the central channel, but are angled such that they cannot be withdrawn. The hook further has a proximal end with an open hook that can be easily attached or detached from a bucket. The tool set further has specially formed wrenches that allow a user to adjust stopcocks that are located in hard to reach locations. The wrenches have open ends and slotted sides to allow them to adjust the stopcocks in multiple ways. That alternative use for the spiked hook is shown which allows it to be used to clean lobsters.

18 Claims, 15 Drawing Sheets

TOOL SET FOR MARINE APPLICATIONS

CROSS-REFERENCE TO RELATED APPLICATIONS

This application is related to, and claims the benefit of, the provisional patent application entitled "Tool Set For Marine Applications", filed Nov. 12, 2009, bearing U.S. Ser. No. 61/260,832 and naming Brad E. Shaffer, the named inventor herein, as sole inventor, the contents of which is specifically incorporated by reference herein in its entirety.

BACKGROUND

1. Technical Field

This invention relates in general to marine equipment and tools, and more particularly it relates to an improved bucket handle and an improved stopcock wrench.

2. Background of the Invention

Boat maintenance can be a difficult task due to the fact that when boats are designed there is an emphasis placed on maximizing space. To do this, it is often difficult to reach components of the boat that need to be serviced due to their inconvenient location. It would be desirable to have a method of accessing components on the boat in a more convenient fashion.

In addition to accessing equipment, there also tools on a boat that can be difficult to carry in an article environment when the boat is rocking. It would be desirable to have a method of comfortably holding items such as buckets, while at the same time maintaining a firm on the bucket.

While the prior art has provided basic tools, it has failed to provide a non-slip grip for buckets, and this further failed to provide a convenient method of accessing equipment controls, such as stopcocks.

SUMMARY OF THE INVENTION

This invention provides a toolset for marine applications that includes improved handle for buckets that provides an improved flexible gripping strap, and further provides a method of securely attaching the flexible gripping strap to specially formed spiked hooks that attach to a bucket. The spiked hook is inserted into a central channel of the flexible gripping strap. The hook has a distal end with angled spikes that allow the hook to be inserted into the central channel, but are angled such that they cannot be withdrawn. The hook further has a proximal end with an open hook that can be easily attached or detached from a bucket. The tool set further has specially formed wrenches that allow a user to adjust stopcocks that are located in hard to reach locations. The wrenches have open ends and slotted sides to allow them to adjust the stopcocks in multiple ways.

DETAILED DESCRIPTION OF THE PREFERRED EMBODIMENT

Figure 1:
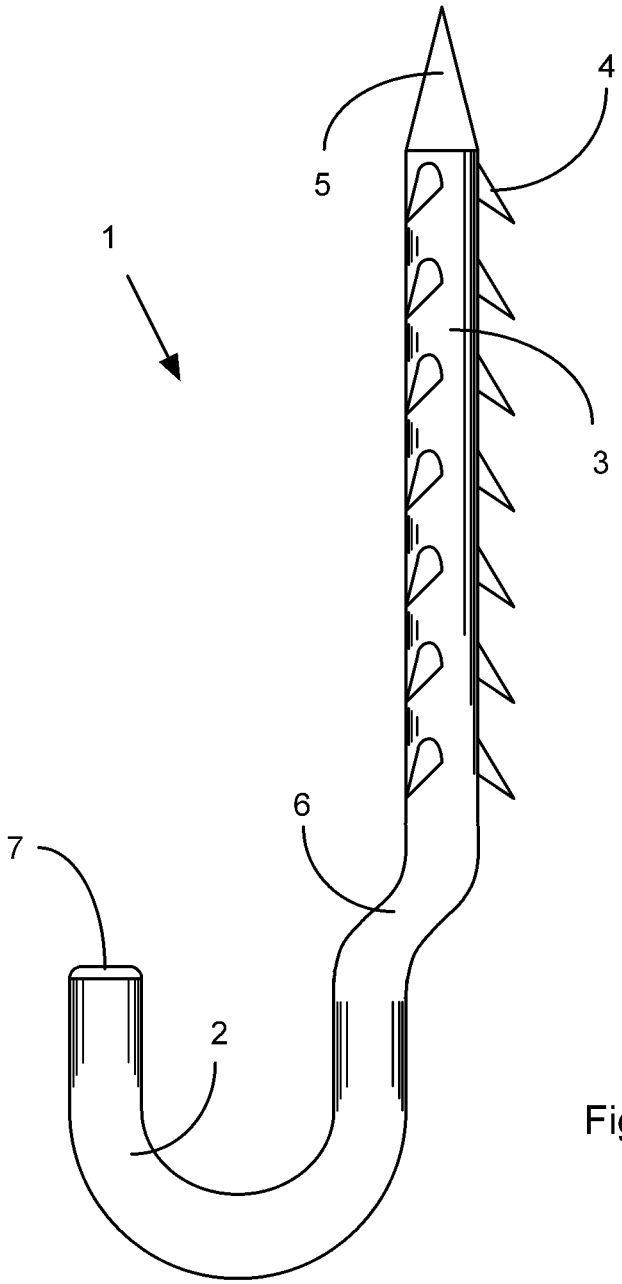
FIG. 1 is a side view of a preferred embodiment of a spiked hook used to attach a flexible gripping strap to a bucket.

FIG. 1 is a side view of a preferred embodiment of a spiked hook 1 used to attach a flexible strap 8 (shown below in regard to FIG. 3) to a bucket 10 (shown below in regard to FIG. 5). As shown in this figure, spiked hook 1 consists of a hook portion 2 that has a proximal end 7 and a distal end 5. The proximal end 7 is sized to fit into an aperture on the side of a bucket 10. The distal end 5 is preferably pointed to facilitate entry of the spiked hook 1 into the flexible gripping strap 8. Spiked hook 1 includes an offset segment 6 to allow the spiked hook 1 to be more easily inserted into an aperture on a bucket 10 without interference from the flexible gripping strap 8.

Also shown in this figure are spikes 4 that protrude from the shaft 3 of spiked hook 1. Preferably, spikes 4 are angled away from distal end 5 to facilitate entry of spiked hook 1 into the internal channel of flexible strap 8. Those skilled in the art will recognize that the number of spikes 4 can vary, as well as their angle, size, and placement on shaft 3. The only requirement for spikes 4 is that they securely grasp flexible gripping strap 8. Further, those skilled in the art recognize that spiked hook number one can be fabricated from any suitable material, such as plastic, metal, wood etc. Of course, if spiked hook 1 is used in harsh environments, such as on a boat, it would be preferable to fabricate spiked hook 1 from the material that is resistant too environmental factors found injury environments such as heat, salt water, and substantial levels of sunlight. For example, spiked hook 1 might preferably be fabricated for such an environment from materials such as plastic, polyethylene, polypropylene, or virgin nylon.

Figure 2:
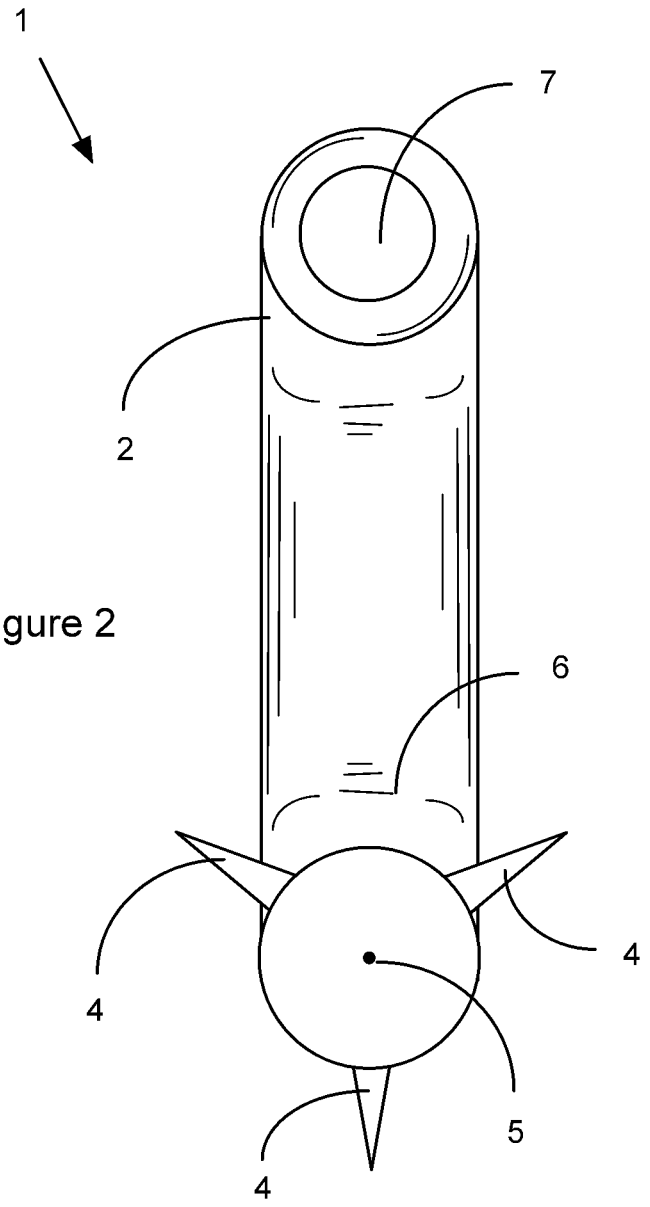
FIG. 2 is a top view of the preferred embodiment of the spiked hook of FIG. 1.

FIG. 2 is a top view of the preferred embodiment of the spiked hook 1 of FIG. 1. This figure provides a better view of spikes 4 distributed about the circumference of shaft 3.

Figure 3A:
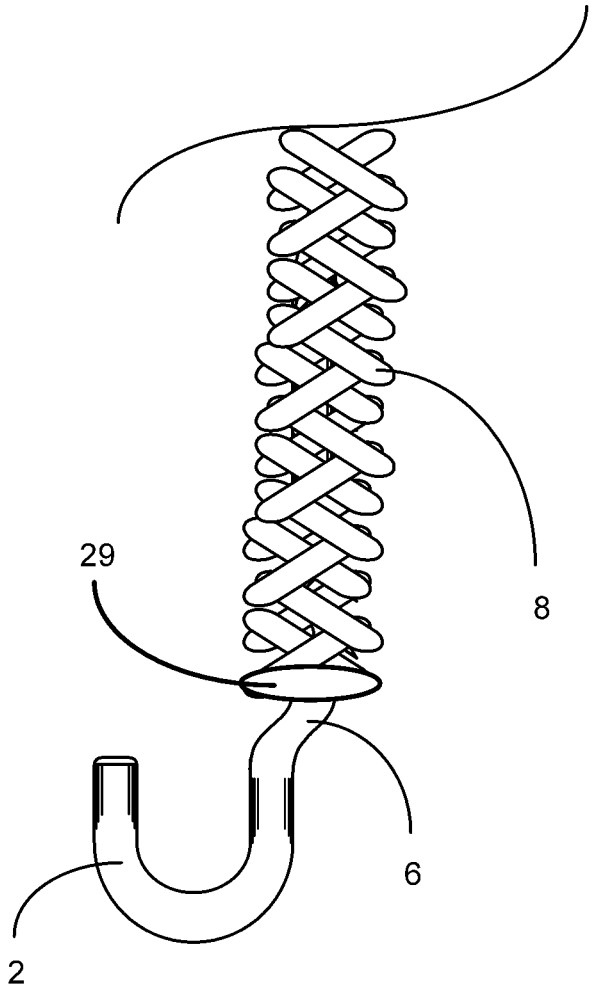
FIG. 3A is a side view of the preferred embodiment of the spiked hook of FIG. 1 inserted into a flexible gripping strap.

FIG. 3A is a side view of the preferred embodiment of the spiked hook 1 of FIG. 1 when it is inserted into a flexible gripping strap 8. In this configuration, flexible gripping strap 8 is constructed such that it has a central channel into which spiked hook 1 is inserted. Once inserted, the spikes 4 will prevent spiked hook 1 from being withdrawn from the flexible gripping strap 8. Also shown in this figure is the optional heat-sealed end 29 of the flexible gripping strap 8. The purpose of heat-sealing the ends of the flexible gripping strap 8 is to prevent the flexible gripping strap 8 from fraying. By preventing fraying, the hollow braid structure of the flexible gripping strap 8 is prevented from unraveling. Of course, alternatives to heat-sealing, such as adhesives, RF bonding, chemical bonding, etc., could be used.

Another important feature of the invention is the hollow braid structure of the flexible gripping strap 8. This structure provides advantages in that it provides a channel for insertion of the spiked hook 1, and further, it provides a softer and more comfortable grip for the individual carrying the attached bucket.

Figure 3B:
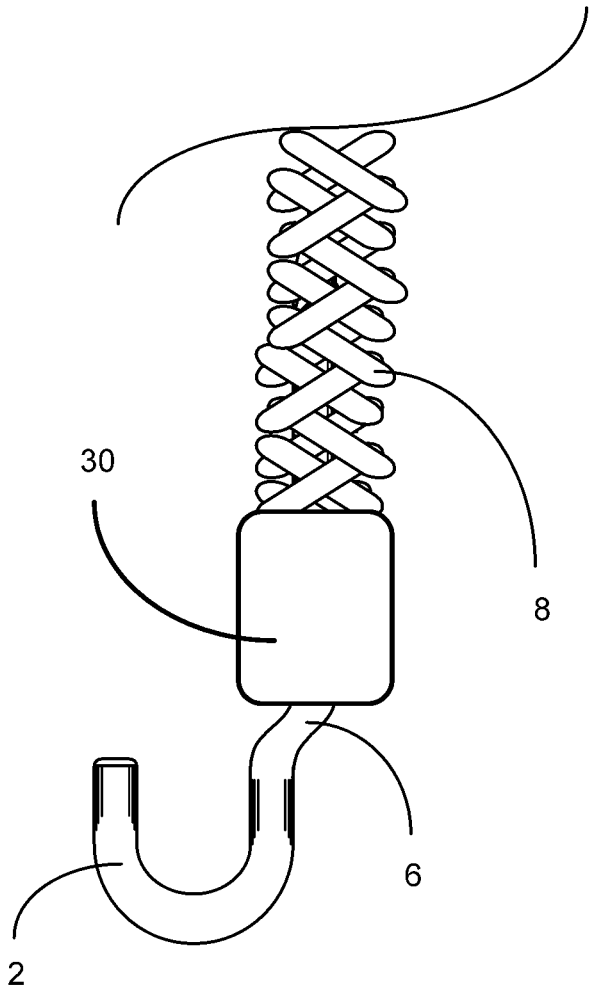
FIG. 3B is a side view of an alternative preferred embodiment of the spiked hook of FIG. 1 inserted into a flexible gripping strap with an option shrink wrap cover over the end of the flexible gripping strap.

FIG. 3B is a side view of an alternative preferred embodiment of the spiked hook 1 of FIG. 1 when it is inserted into a flexible gripping strap 8. In this configuration, flexible gripping strap 8 includes an optional shrink wrap cover on the end of the flexible gripping strap that is intended to prevent fraying of the flexible gripping strap 8, and put improve its aesthetics.

Figure 4:
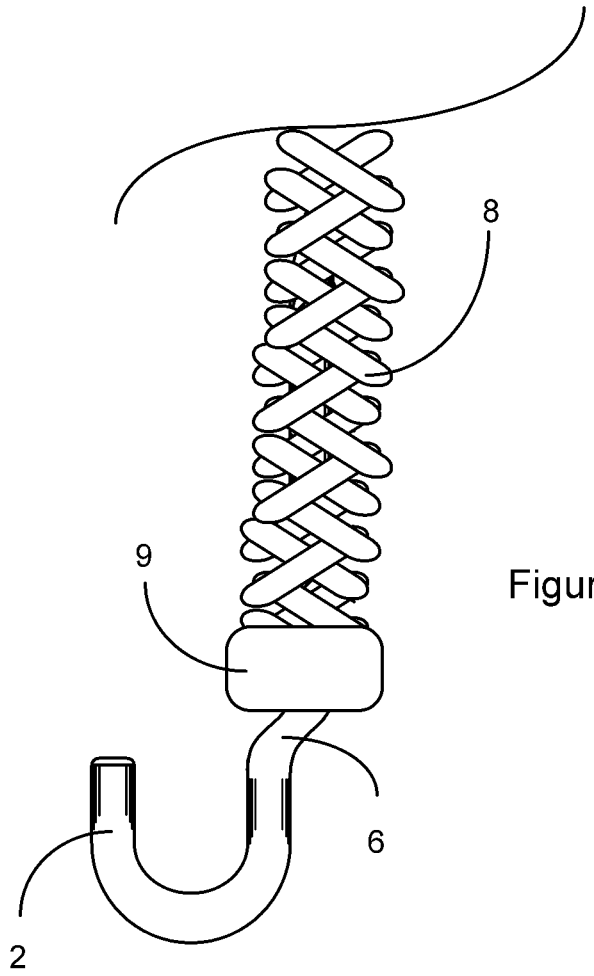
FIG. 4 is a side view of the preferred embodiment of the spiked hook of FIG. 1 inserted into the flexible gripping strap with an optional retaining ring securing the flexible gripping strap to the spiked hook.

FIG. 4 is a side view of the preferred embodiment of the spiked hook 1 of FIG. 1 inserted into the flexible gripping strap 8 with an optional retaining ring 9 which further secures the flexible gripping strap 8 to the spiked hook 1. Retaining ring 9 can be tape, it can be a rigid plan, etc. The only requirement is that retaining ring 9 protects the end of flexible gripping strap 8 such that it does not get damaged during ordinary use. It also serves to further prevent flexible gripping strap 8 from disengaging from spiked hook 1.

Figure 5:
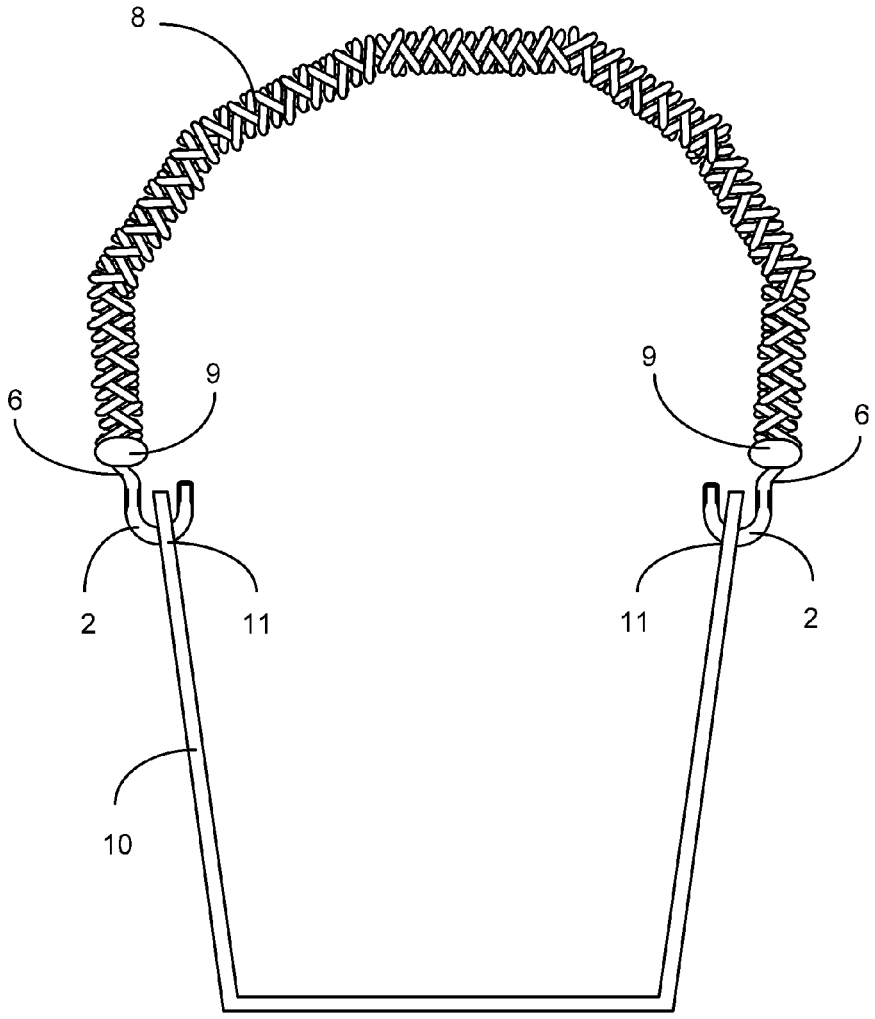
FIG. 5 is a side cross-sectional view of a preferred embodiment of the spiked hook and flexible gripping strap attached to a bucket.

FIG. 5 is a side cross-sectional view of a preferred embodiment of the spiked hook 1 and flexible gripping strap 8 attached to a bucket 10. In this view, hook portions 2 are inserted through apertures 11 in the side of bucket 10. This figure also illustrates how offset segment 6 positions flexible gripping strap 8 away from the edge of bucket 10.

Figure 6:
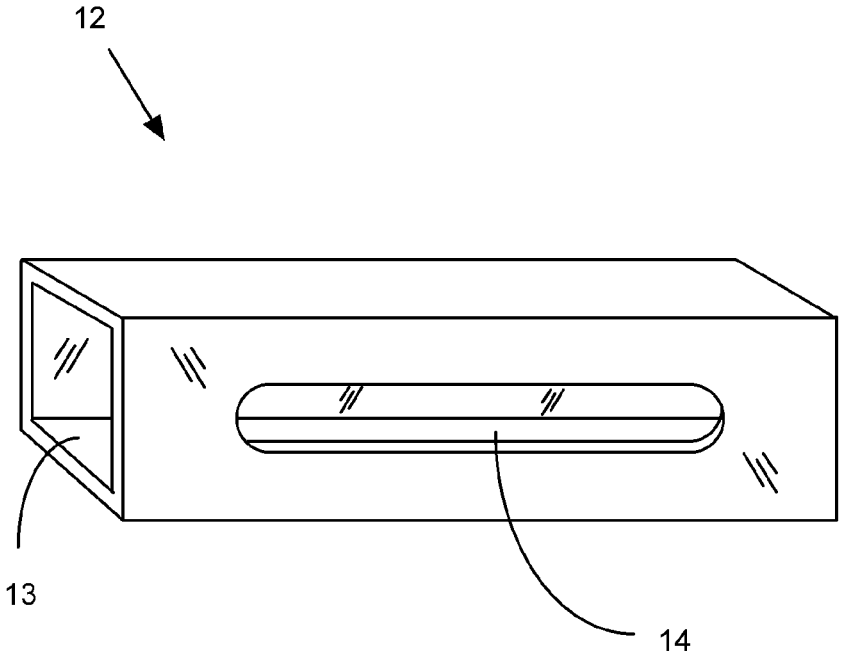
FIG. 6 is a perspective view of a preferred embodiment of a stopcock wrench.

FIG. 6 is a perspective view of a preferred embodiment of a stopcock wrench 12. In this embodiment, stopcock wrench 12 is a rigid structure having an open end 13, and at least one slot 14. The open end 13 and the slot 14 are sized such that they can fit over a stopcock lever 17 (shown below in regard to FIG. 7A). Stopcock wrench 12 can be fabricated from any suitable material. However, stopcock lever's 17 oftentimes require a substantial amount of force to turn. As a result, stopcock wrench 12 should preferably be fabricated from material having substantial strength, such as metal.

Figure 7A:
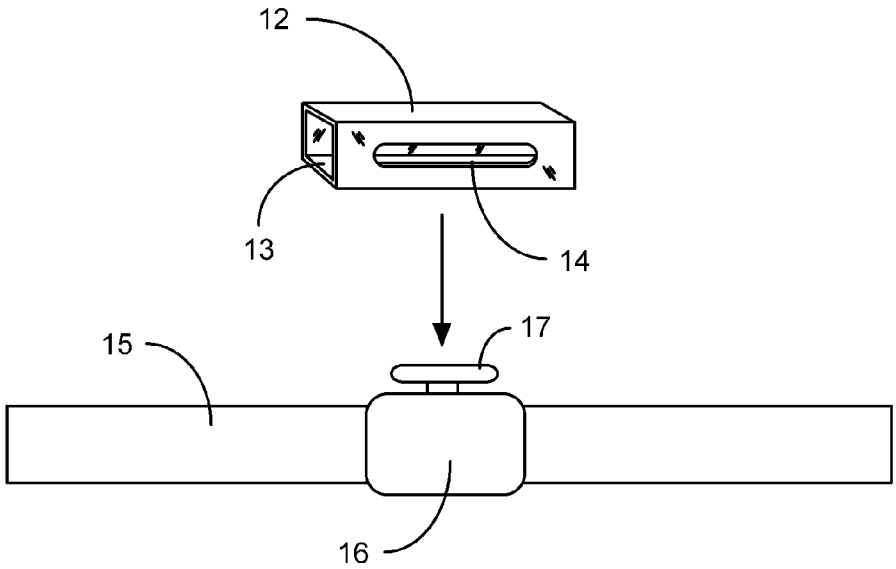
FIG. 7A is a side view of the stopcock wrench of FIG. 6 with its side slot aligned with a stopcock lever.

FIG. 7A is a side view of the stopcock wrench 12 of FIG. 6 with its slot 14 aligned with a stopcock lever 17. While the size of the stopcock wrench 12, and its associated slot 14 will vary based on its intended use, the slot 14 should be sized such that it can easily fit over stopcock lever 17.

Figure 7B:
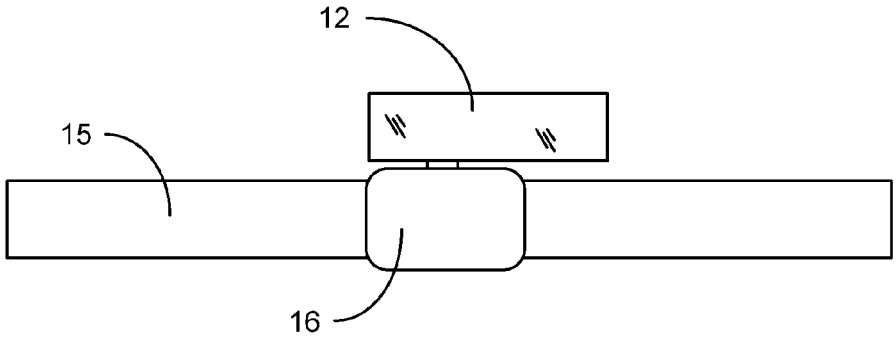
FIG. 7B is a side view of the stopcock wrench of FIG. 6 with the side slot inserted over the stopcock lever.

FIG. 7B is a side view of the stopcock wrench 12 of FIG. 6 with the slot 14 inserted over the stopcock lever 17. Once joined in this manner, the stopcock wrench 12 can provide additional leverage to turn stopcock lever 17. A significant advantage of stopcock wrench 12 is that it has a minimal size that allows it to be used in very close quarters were conventional wrenches may not fit.

Figure 8A:
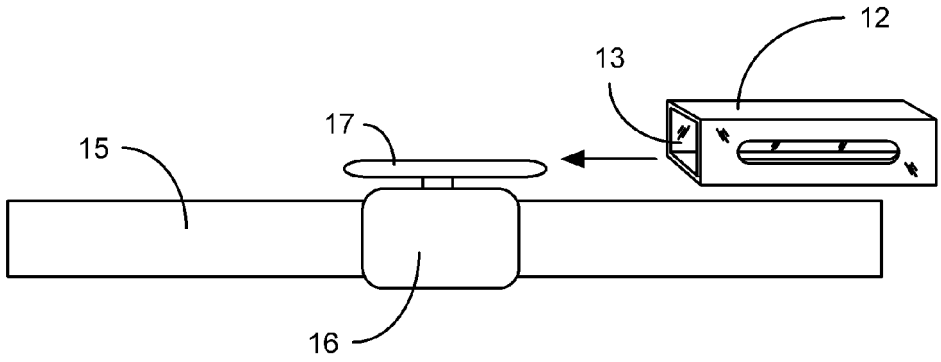
FIG. 8A is a side view of the stopcock wrench of FIG. 6 with its open end aligned with a stopcock lever.

FIG. 8A is a side view of the stopcock wrench 12 of FIG. 6 with its open end 13 aligned with a stopcock lever 17. When used in this manner, the open end 13 of stopcock 12 should be sized such that it can easily fit over the end of stopcock lever 17.

Figure 8B:
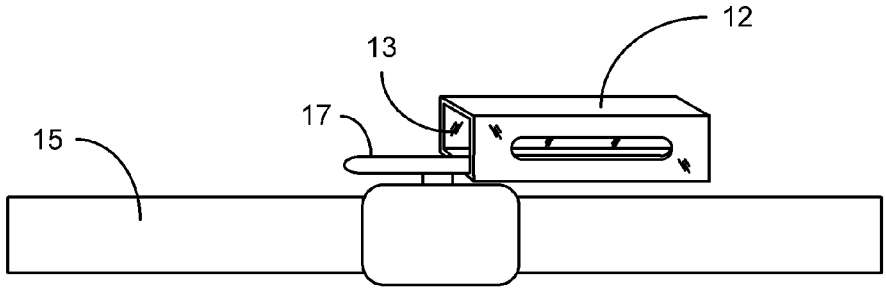
FIG. 8B is a side view of the stopcock wrench of FIG. 6 with the open end inserted over the stopcock lever.

FIG. 8B is a side view of the stopcock wrench 12 of FIG. 6 with the open end 13 installed on the end of stopcock lever 17. As was the case above, stopcock wrench 12 provides additional leverage while requiring a minimum amount of space to allow its use in tight quarters.

Figure 9A:
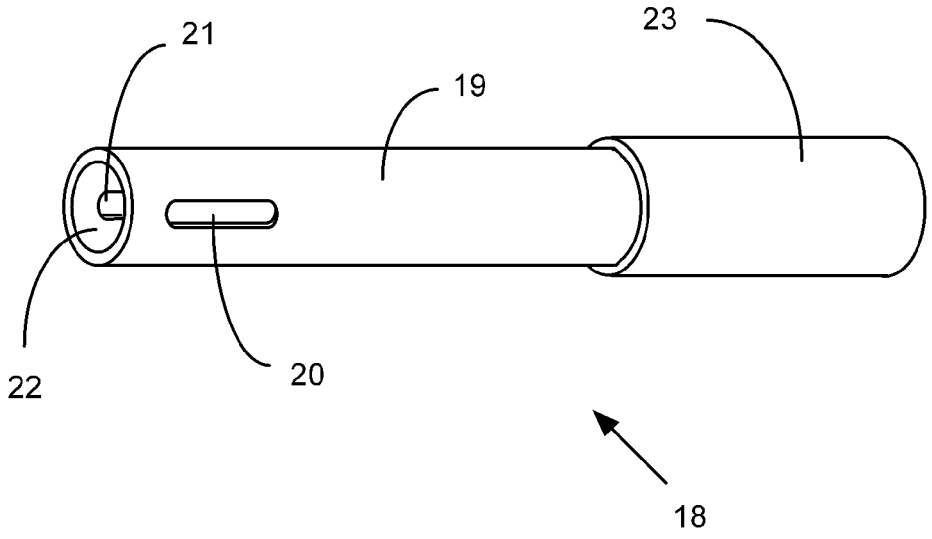
FIG. 9A is a perspective view of an alternative preferred embodiment of the stopcock wrench that illustrates side slots and the open end.

FIG. 9A is a perspective view of an alternative preferred embodiment of the stopcock wrench 18 that illustrates slots 20, 21 and the open end 22. This embodiment also provides a resilient grip 23 allow the user to more comfortably grasp the device. This embodiment of the stopcock wrench 18 can also be fabricated from a suitable material, such as metal, PVC pipe, etc. It is intended that this embodiment be used for having stopcocks having larger levers, and thus requiring greater leverage.

Figure 9B:
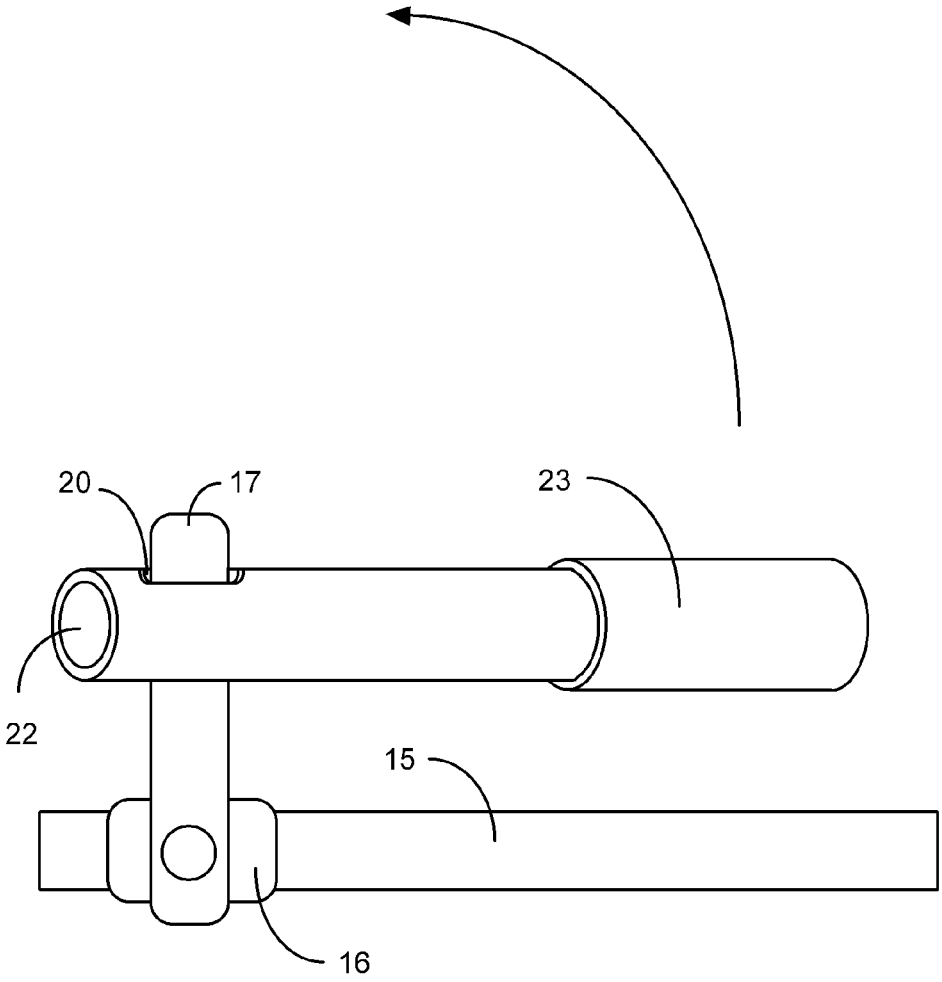
FIG. 9B is a side view of the preferred embodiment of FIG. 9A showing the stopcock wrench with the stopcock lever inserted through the side slots of the stopcock wrench.

FIG. 9B is a side view of the preferred embodiment of FIG. 9A showing the stopcock wrench 18 with the stopcock lever 17 inserted through the slots 21, 22 of the stopcock wrench 18. The arrow above grip 23 indicates direction of motion of stopcock wrench 18 when moving stopcock lever 17.

Figure 9C:
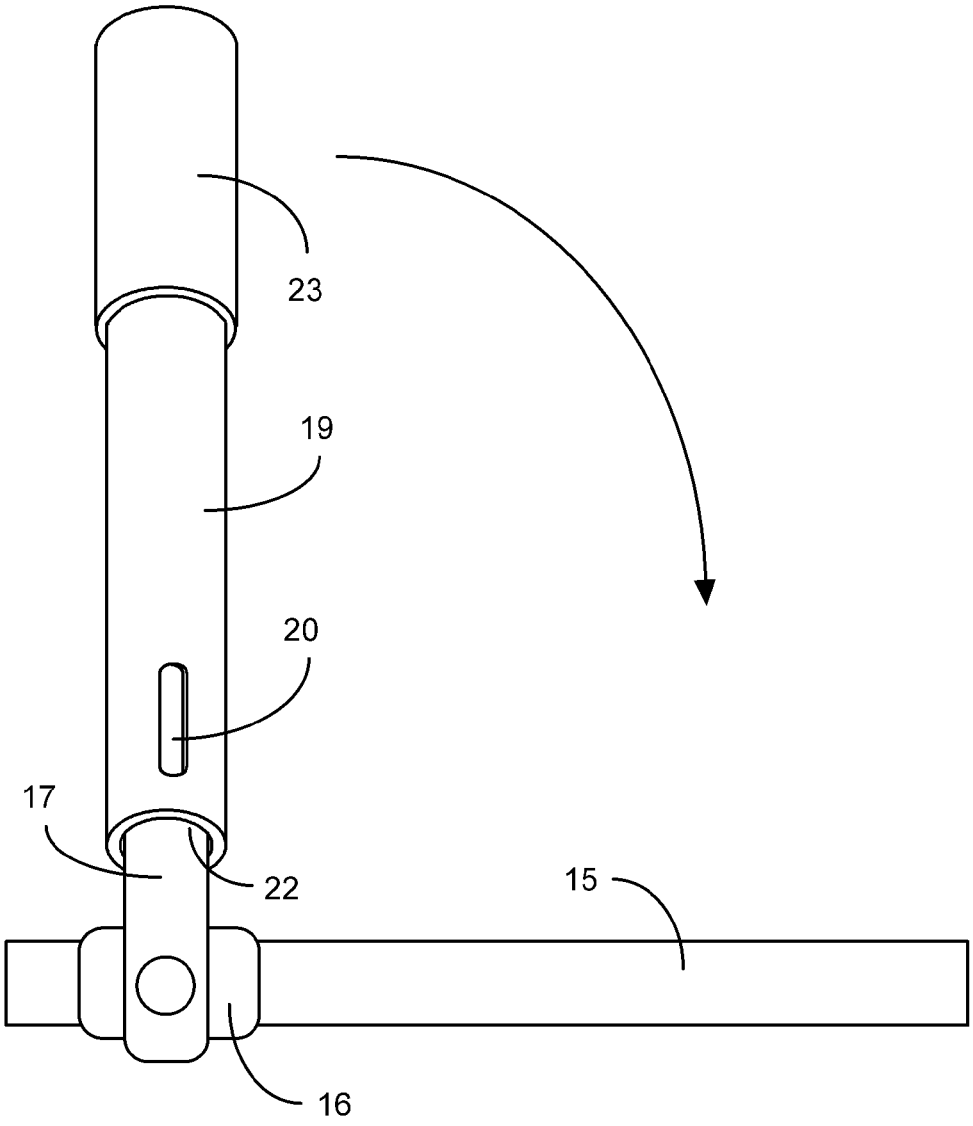
FIG. 9C illustrates a side view of the alternative preferred embodiment of FIG. 9A showing the stopcock wrench with the stopcock lever inserted into the open end of the stopcock wrench.

FIG. 9C illustrates a side view of the preferred embodiment of FIG. 9A showing an alternative method of using stopcock wrench 18. In this figure, the open end 22 of stopcock wrench 18 is installed on stopcock lever 17. As was the case in FIG. 9B, the arrow above grip 23 indicates direction of motion of stopcock wrench 18 when moving stopcock lever 17.

As was the case with the previous embodiments, embodiments of FIGS. 9A-C provides a stopcock wrench 18 that provides improved leverage while requiring a minimum amount of space to operate.

Those skilled in the art will recognize that the embodiments illustrated in FIGS. 6-9 are not limited to adjustment of stopcocks. For example, any item that needs to be tightened or loosened, such as a wingnut, can be tightened or loosened using the stopcock wrench 12 providing that the item is suitable sized to fit the particular stopcock wrench 12.

Figure 10A:
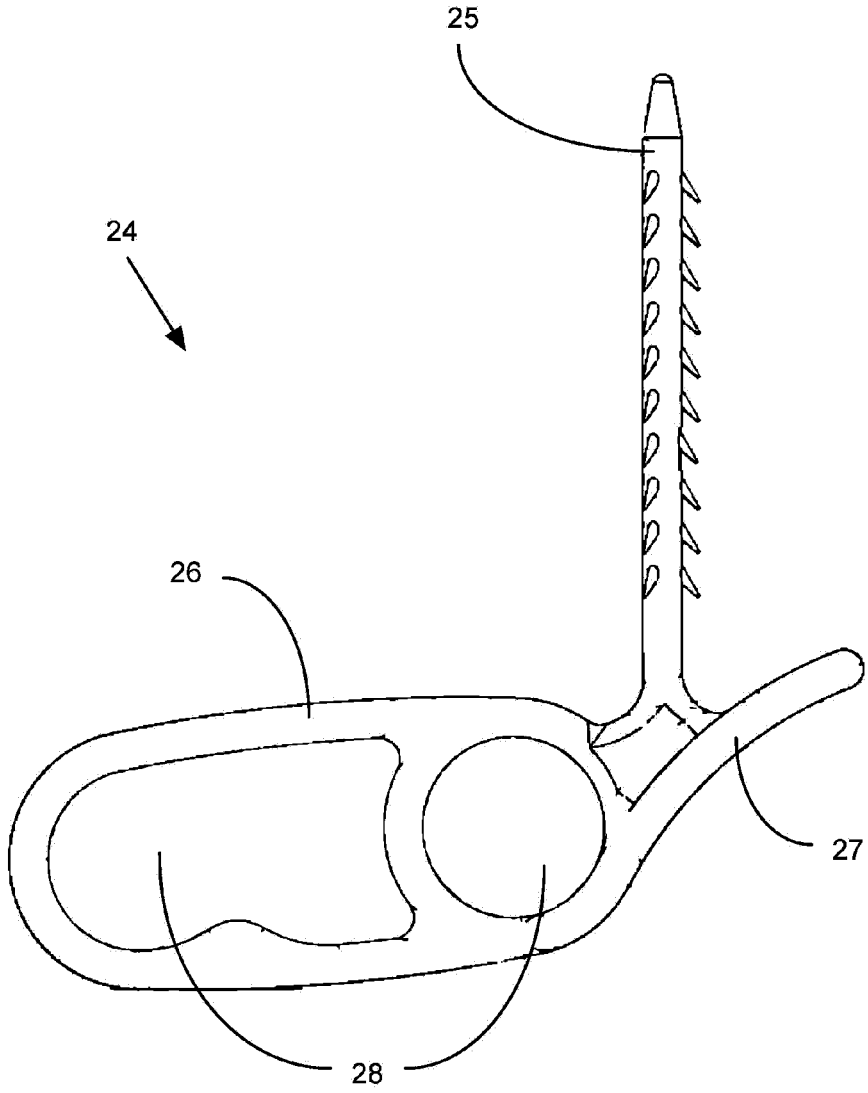
FIG. 10A is a side view of a preferred embodiment of an alternative use for the spiked hook of FIG. 1 that is used in this embodiment to clean lobster.

FIG. 10A is a side view of a preferred embodiment of an alternative use for the spiked hook 1 of FIG. 1 that is used in this embodiment to form a lobster cleaning tool 24, which allows fishermen hooks, etc. to rapidly and conveniently clean lobster. In this embodiment, spiked hook 25 is attached to a handle 26 of lobster cleaning tool 24. The handle 26 includes a thumb rest 27, and figure apertures 28. The spiked hook 25 extends from handle 26, and is used to enter and remove the digestive tract of the lobster for the purpose of cleaning it prior to cooking.

Figure 10B:
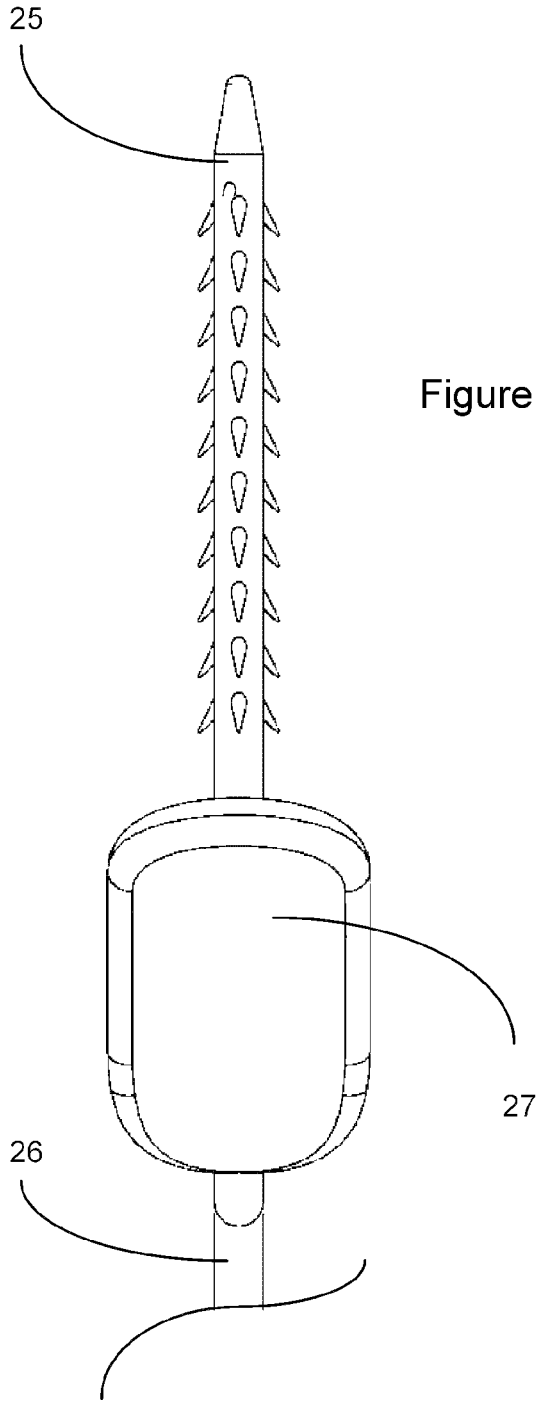
FIG. 10B is a top view of the preferred embodiment of the spiked hook of FIG. 10A.

FIG. 10B is a top view of the preferred embodiment of the lobster cleaning tools 24 of FIG. 10A. This figure illustrates the thumb rest 27.

Figure 11:
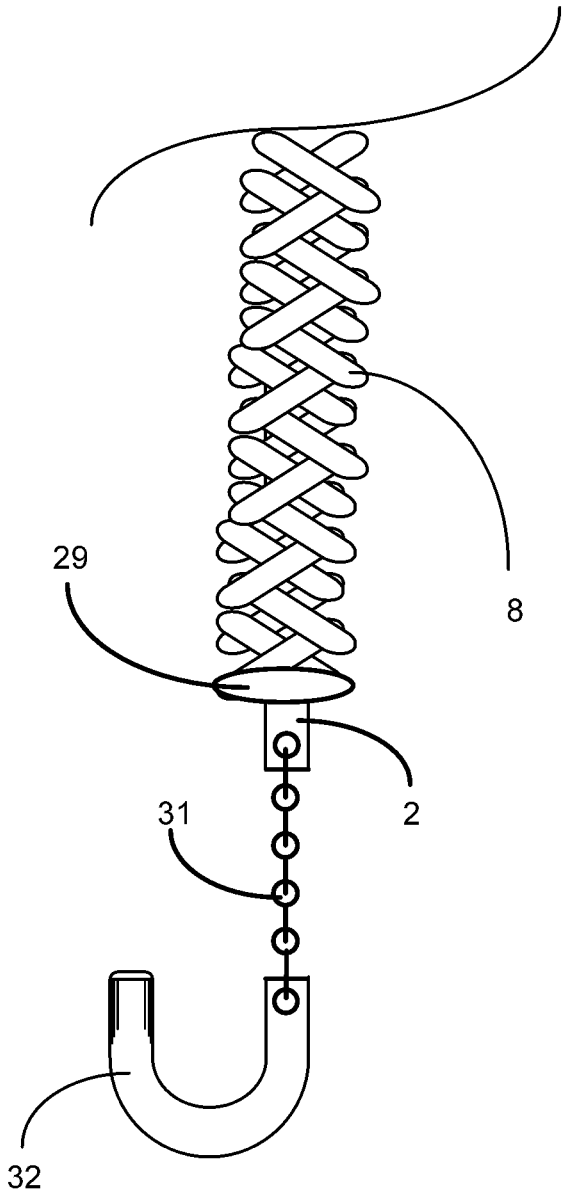
FIG. 11 is a side view of an alternative preferred embodiment of the spiked hook in which the spiked hook is connected via a chain to the bucket attachment.

FIG. 11 is a side view of an alternative preferred embodiment of the spiked hook 1 in which the spiked hook 1 is connected via a chain leader 31 to the bucket attachment 32. This embodiment allows the flexible gripping strap 8 to be shortened to form a conventional handle while the chain leader 31 provides a strong carrying strap.

While the preferred embodiments show the stopcock wrench having slots on both sides and open ends, variations in the structure could be made. For example, a solid stopcock wrench can be fabricated with no open end, and a single slot that extends partly, or completely through, the body the stopcock wrench.

While specific embodiments have been discussed to illustrate the invention, it will be understood by those skilled in the art that variations in the embodiments can be made without departing from the spirit of the invention. Therefore, the invention shall be limited to the scope of the claims.

I claim:

1. A flexible strap for carrying a bucket, comprising:

a flexible gripping strap having first and second ends;

first and second spiked hooks, each spiked hook having a distal end with means to attach to a bucket, and a proximal end with means to attach to the first or second end of the flexible strap;

the first spiked hook secured to the first end of the flexible strap and the second spiked hook attached to the second end of the flexible strap; and each spiked hook having a plurality of spikes for securing the spiked hook to the flexible strap;

whereby the spiked hooks, when secured to the flexible strap, prevents the flexible gripping strap from disengaging from the spikes.

2. A flexible strap, as in claim 1, further comprising:

each end of the flexible strap having a central channel in the flexible strap sized to snugly and slidably accept the proximal end of a spiked hook.

3. A flexible strap, as in claim 2, wherein:

the plurality of spikes extending outward from the spiked hook, and the plurality of spikes further angled toward the distal end of the spiked hook such that the spiked hook can slide into the flexible strap, and is prevented from sliding out by the spikes.

4. A flexible strap, as in claim 3, wherein:

the distal end of the spiked hook has a hook shaped end that movably securable to an aperture in a bucket.

5. A flexible strap, as in claim 3, further comprising:

means to seal the first and second ends of the flexible strap such that fraying and/or unraveling is prevented.

6. A flexible strap, as in claim 5, wherein:

the first and second ends of the flexible strap is sealed by heat sealing, RF bonding, adhesives, shrink wrap, or chemical bonding.

7. A flexible strap, as in claim 6, further comprising:

first and second retaining rings to secure the first and second ends, respectively, of the flexible strap to the spiked hooks.

8. A flexible strap, as in claim 7, wherein:

the distal end of the spiked hook has a hook shaped end that movably securable to an aperture in a bucket.

9. A flexible strap, as in claim 5, wherein:

the distal end of the spiked hook has a hook shaped end that movably securable to an aperture in a bucket.

10. A flexible strap, as in claim 3, wherein:

first and second retaining rings to secure the first and second ends, respectively, of the flexible strap to the spiked hooks.

11. A flexible strap, as in claim 10, wherein:

the distal end of the spiked hook has a hook shaped end that movably securable to an aperture in a bucket.

12. A flexible strap, as in claim 2, wherein:

the flexible strap is a hollow braid structure that encloses the central channel.

13. A flexible strap, as in claim 12, further comprising:

means to seal the first and second ends of the flexible strap such that fraying and/or unraveling is prevented.

14. A flexible strap, as in claim 13, wherein:

the first and second ends of the flexible strap is sealed by heat sealing, RF bonding, adhesives, shrink wrap, or chemical bonding.

15. A flexible strap, as in claim 14, further comprising:

first and second retaining rings to secure the first and second ends, respectively, of the flexible strap to the spiked hooks.

16. A flexible strap, as in claim 13, wherein:

the distal end of the spiked hook has a hook shaped end that movably securable to an aperture in a bucket.

17. A flexible strap, as in claim 12, wherein:

first and second retaining rings to secure the first and second ends, respectively, of the flexible strap to the spiked hooks.

18. A flexible strap, as in claim 17, wherein:

the distal end of the spiked hook has a hook shaped end that movably securable to an aperture in a bucket.

* * * * *